US006659622B2

(12) United States Patent
Katogi et al.

(10) Patent No.: US 6,659,622 B2
(45) Date of Patent: Dec. 9, 2003

(54) ILLUMINATION SYSTEM AND ILLUMINATION UNIT

(75) Inventors: Masayuki Katogi, Tokyo (JP); Naohisa Iso, Tokyo (JP)

(73) Assignee: Moriyama Sangyo Kabushiki Kaisha, Tokyo (JP)

( * ) Notice: Subject to any disclaimer, the term of this patent is extended or adjusted under 35 U.S.C. 154(b) by 20 days.

(21) Appl. No.: 09/990,006

(22) Filed: Nov. 21, 2001

(65) Prior Publication Data

US 2002/0114155 A1 Aug. 22, 2002

(30) Foreign Application Priority Data

Nov. 24, 2000 (JP) ..... 2000-358184

(51) Int. Cl.[7] ..... F21S 4/00

(52) U.S. Cl. ..... 362/219; 362/231; 362/240; 362/251; 362/249; 439/505; 315/219

(58) Field of Search ..... 362/219, 231, 362/238, 240, 800, 249, 251; 439/505, 502, 503, 504; 315/29 R, 219

(56) References Cited

U.S. PATENT DOCUMENTS

| | | | | |
|---|---|---|---|---|
| 4,057,310 A | * | 11/1977 | Young | 439/35 |
| 5,281,147 A | * | 1/1994 | Hughes | 439/35 |
| 5,697,810 A | * | 12/1997 | Barry | 439/503 |
| 6,016,038 A | * | 1/2000 | Mueller et al. | 315/291 |
| 6,283,612 B1 | * | 9/2001 | Hunter | 362/240 |

* cited by examiner

*Primary Examiner*—Alan Cariaso
*Assistant Examiner*—Ali Alavi
(74) *Attorney, Agent, or Firm*—Marshall & Melhorn, LLC

(57) ABSTRACT

An illumination system of the invention comprises: a first illumination unit comprising a pair of power supply contacts for connection to a commercial AC power source, a light source connected between the pair of power supply contacts, a control circuit connected in series to the light source to control electric current flowing through the light source, and a connection cord connected to the light source; and a second illumination unit comprising a light source and a connection cord connected to the light source, wherein the connection cord of the first illumination unit and the connection cord of the second illumination unit are connected to each other so that the light source of the first illumination unit and the light source of the second illumination unit are connected in parallel to each other.

13 Claims, 9 Drawing Sheets

ILLUMINATION SYSTEM AND ILLUMINATION UNIT

TECHNICAL FIELD

The present invention relates to an illumination system, and particularly relates to a color/general illumination system suitable for illuminating a relatively wide range of area as in cove-lighting.

BACKGROUND OF THE INVENTION

In hotels and restaurants, a so-called indirect lighting that illuminates the space by the light reflected from the wall, ceiling or floor is widely adopted. One way of such indirect lighting is known as "cove-lighting" in which, typically, a horizontally extending trough called a "cove" is provided to a portion of a wall surface near the ceiling and an illumination device is concealedly placed in the cove to emit light to the ceiling. An illumination system for such cove-lighting usually comprises a plurality of illumination devices disposed along the cove to achieve as uniform illumination as possible along the entire length of the cove.

In such conventional illumination systems using a plurality of illumination devices, however, each of the illumination devices was independently connected to the power supply, and thus there was a problem that the cable routing work tended to be complicated and require a long time. Also, in such a case that the space for installing the illumination system was limited (e.g., when the cove width was tightly narrow), a further problem could arise that there was not a sufficient room for cable routing.

Besides, recently, light emitting diodes (LEDs) have been used in wider fields as a light source of an illumination device. Since the LEDs dissipate less heat, they are suitable for a light source of cove-lighting devices which tend to be placed in a relatively narrow space. In a case that LEDs of three primary colors (red, green and blue) are used as light sources, additive mixture of the red, green and blue lights emitted from the LEDs with controlled proportion of the RGB lights can allow the ceiling, wall and the like to be illuminated in desired colors, which would significantly enhance the illumination effect. However, in order to conduct such color illumination, it is necessary to provide the illumination device with a control unit (such as a CPU) for controlling the LEDs of one color independently from the LEDs of the other colors, resulting in a higher manufacturing cost of the illumination device. This problem can be conspicuous particularly in such an illumination system that utilizes a plurality of illumination devices to illuminate light in relatively wide areas as in the cove-lighting.

BRIEF SUMMARY OF THE INVENTION

In view of such problems of the prior art, a primary object of the present invention is to provide an illumination system that can significantly reduce the effort and time required for cable routing.

A second object of the present invention is to provide an illumination system that can illuminate relatively wide areas with a minimized cost increase.

A third object of the present invention is to provide an illumination system that is suitable for use in a relatively limited installation space.

A fourth object of the present invention is to provide an illumination system that can allow easy cable routing and provide a greater freedom of arrangement.

A fifth object of the present invention is to provide a color illumination system that can conduct color illumination in relatively wide areas without causing a significant cost increase.

A sixth object of the present invention is to provide an illumination device that requires a small installation space and is easy to handle.

According to the present invention, such objects can be accomplished by providing an illumination system, comprising: a first illumination unit comprising a pair of power supply contacts for connection to a commercial AC power source, a light source connected between the pair of power supply contacts, a control circuit connected in series to the light source to control electric current flowing through the light source, and a first connection cord connected to the light source; and a second illumination unit comprising a light source and a first connection cord connected to the light source, wherein the first connection cord of the first illumination unit and the first connection cord of the second illumination unit are connected to each other so that the light source of the first illumination unit and the light source of the second illumination unit are connected in parallel to each other. In such a configuration, it is possible to supply electric power to the second illumination unit (sub unit) via the first illumination unit (main unit) as well as to control the light source of the second illumination unit by the control circuit of the first illumination unit. Therefore, the second illumination unit does not need its own power cable for direct connection to an outside power source such as the commercial AC power source, and therefore, not only a space required for the cable routing is reduced but also an effort and time for the cable routing can be considerably reduced. Also, since the second illumination unit does not have to comprise a control circuit, the manufacturing cost thereof can be minimized.

Preferably, the second illumination unit further comprises a second connection cord connected to the light source commonly with the first connection cord. By using the second connection cord, the second illumination unit can be further connected to another illumination unit. Also, if each of the illumination units comprises a longitudinal support member for supporting the light source, and each connection cord is provided in a vicinity of an associated longitudinal end of the support member of each illumination unit, connection of longitudinally adjoining illumination units can be made easily. This would make the illumination system particularly suitable for use in linear lighting such as cove-lighting, for example. In general, in accordance with this aspect of the present invention, an arbitrary number of illumination units (sub units) that, like the second illumination unit, do not comprise a control circuit can be joined together to achieve an illumination system of a desired length with minimized increase in the total system cost.

Further preferably, the first illumination unit further comprises a second connection cord connected to the light source commonly (or in parallel) with the first connection cord, the system further comprises a third illumination unit comprising a light source and a first connection cord connected to the light source, and the second connection cord of the first illumination unit is connected to the first connection cord of the third illumination unit so that the light source of the first illumination unit and the light source of the third illumination unit are connected in parallel to each other. In this way, the second and third illumination units can be connected to the first illumination unit in a bifurcated relationship (referred to herein as "bifurcation connection" or "bifurcation joint"), which can result in significant increase in the design freedom of system layout.

According to another aspect of the present invention, there is provided an illumination system, comprising: first and second illumination units, each having a light source and first and second connection cords commonly connected to the light source: and a control unit separate from the first and second illumination units, the control unit having a pair of power supply contacts and a control circuit, wherein the first illumination unit is connected to the control unit via its first connection cord so that the light source of the first illumination unit is connected between the pair of power supply contacts of the control unit via the control circuit of the control unit; wherein the second connection cord of the first illumination unit is connected to the first connection cord of the second illumination unit so that the light source of the first illumination unit and the light source of the second illumination unit are connected in parallel to each other; and wherein each of the first and second illumination unit has a longitudinal support member for supporting the light source and each connection cord is provided in a vicinity of an associated end of the support member of each illumination unit. In such a configuration, the light source in each of the illumination units can be controlled by the control unit separate from the illumination units, and therefore each illumination unit does not have to be equipped with its own control circuit. This can lead to a reduced total manufacturing cost of the illumination system. Also, since each illumination unit can be supplied with electric power via adjacent illumination unit connected thereto via the connection cord, there is no need for each illumination unit to have its own power cable for direct connection to an outside power source such as the commercial AC power source. The control unit does not have to be located near the illumination units at the site, and can be installed on an interior wall of a room, for example, so that the control unit can be readily operable by the user.

It will be preferable if each of the first and second illumination units further comprises a light-transmissive tubular member for accommodating the support member and the light source, and a cap member having a bottom wall and a cylindrical side wall and attached to an end of the tubular member, with the bottom wall being formed with a groove or slit for receiving an associated end of the support member. In this way, even when the system is installed in dusty environment, the tubular member and the cap member can advantageously prevent dust from causing damage to the light source or any circuits in the illumination units or facilitate maintenance or cleaning of the illumination units. The groove or slit formed in the cap member to receive the end of the support member allows easy and quick assembly of the illumination unit. If the side wall of the cap member is formed with a hole so as to allow an associated connection cord to be drawn out therethrough, it is possible to place longitudinally adjacent illumination units closely to each other, desirably allowing a "seamless" illumination having substantially no dark areas between the adjacent units. Also, in the case that the light source of each of the first and second illumination units comprises a plurality of light emitting elements, it will be preferable if the longitudinal support member consists of a printed circuit board on which the plurality of light emitting elements are mounted so that the mechanical support and the electric connection of the light emitting elements can be achieved simultaneously.

The illumination system can be preferably implemented as a color illumination system if the light source of each of the first and second illumination units comprises a red light source, a green light source and a blue light source; the control circuit comprises first, second and third control elements connected in series to the red light source, green light source and blue light source, respectively, of the first illumination unit; and the second connection cord of the first illumination unit and the first connection cord of the second illumination unit are connected to each other so that light sources of a same color in these illumination units are connected in parallel to each other. As a modified embodiment, it is also possible that the second connection cord of the first illumination unit and the first connection cord of the second illumination unit are provided with respective connectors which are adapted so that light sources of different colors in the first and second illumination units can be connected in parallel to each other via the connectors. Preferably, the red light source comprises a red LED set having a series-connected plurality of red LEDs, the green light source comprises a green LED set having a series-connected plurality of green LEDs, and the blue light source comprises a blue LED set having a series-connected plurality of blue LEDs, and each of the first, second and third control elements consists of a switching element. By using LEDs and switching elements, the power consumption and heat generation of each illumination unit can be minimized, allowing a number of illumination units to be joined together without causing a problem.

According to yet another aspect of the present invention, there is provided an illumination unit, comprising: a pair of power supply contacts for connection to a commercial AC power source; a light source comprising a plurality of LEDs mounted on one side of a longitudinal printed circuit board, the light source being connected between the pair of power supply contacts; a control circuit attached on the other side of the printed circuit board and connected in series to the light source; a transformer-less AC/DC converter attached on the other side of the printed circuit board and connected to the power supply contacts in order to supply a DC voltage to the control circuit; and a light transmissive tubular member for accommodating the light source, printed circuit board, control circuit and transformer-less AC/DC converter. Since the light source, printed circuit board, control circuit and transformer-less AC/DC converter are all accommodated in the tubular member, an illumination unit that is easy to handle and has a small footprint can be provided. This illumination unit can be directly connected to the commercial AC power source, and thus can serve as an independent, stand-alone illumination device.

According to further aspect of the present invention, there is provided an illumination unit, comprising: a light source, and at least three connection cords commonly connected to the light source so as to enable the illumination unit to make a bifurcation connection with other illumination units. The "bifurcation connection" of illumination units can lead to a greater freedom in layout of the illumination system comprising the illumination units. Such an illumination unit can be implemented as a color illumination unit if the light source comprises a red light source, a green light source and a blue light source, and each of the connection cord is provided with a connector which has a first pin connected to a common line, a second pin connected to the red light source, a third pin connected to the green light source and a fourth pin connected to the blue light source. In the illumination unit for enabling "bifurcation connection" also, in view of facilitating longitudinal arrangement of illumination units, it will be preferable if the unit further comprises a longitudinal support member for supporting the light source, wherein at least one of the connection cords is provided in a vicinity of one end of the support member and at least one of the other connection cords is provided in a vicinity of the other end of the support member.

Other and further objects, features and advantages of the invention will appear more fully from the following description.

BRIEF DESCRIPTION OF THE DRAWINGS

Now the present invention is described in the following with reference to the appended drawings, in which.

It should be noted that similar or same component parts are denoted with same reference numerals in the drawings.

DETAILED DESCRIPTION OF THE PREFERRED EMBODIMENTS

Figure 1:
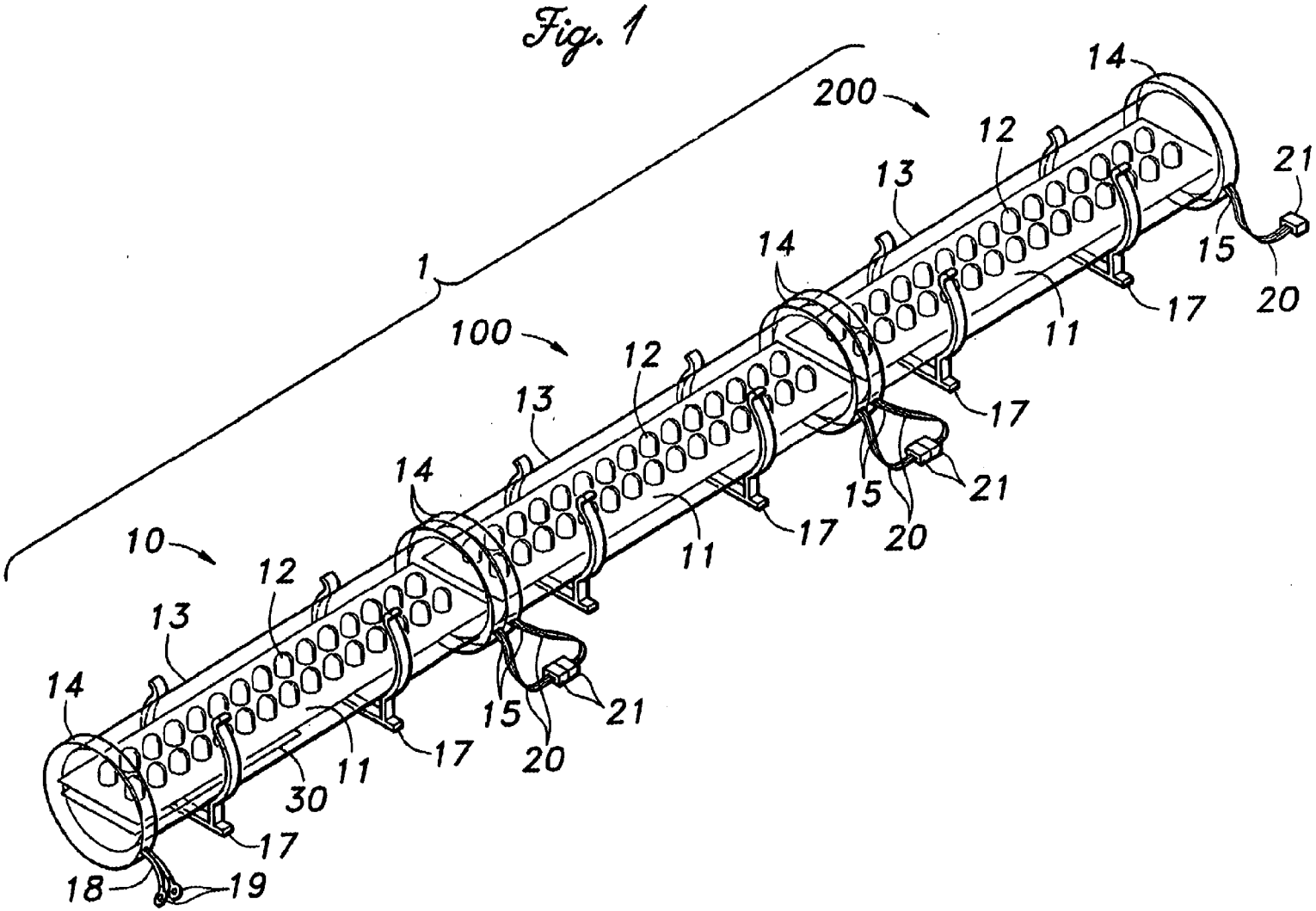
FIG. 1 is a perspective view of an illumination system according to the present invention.
Figure 2:
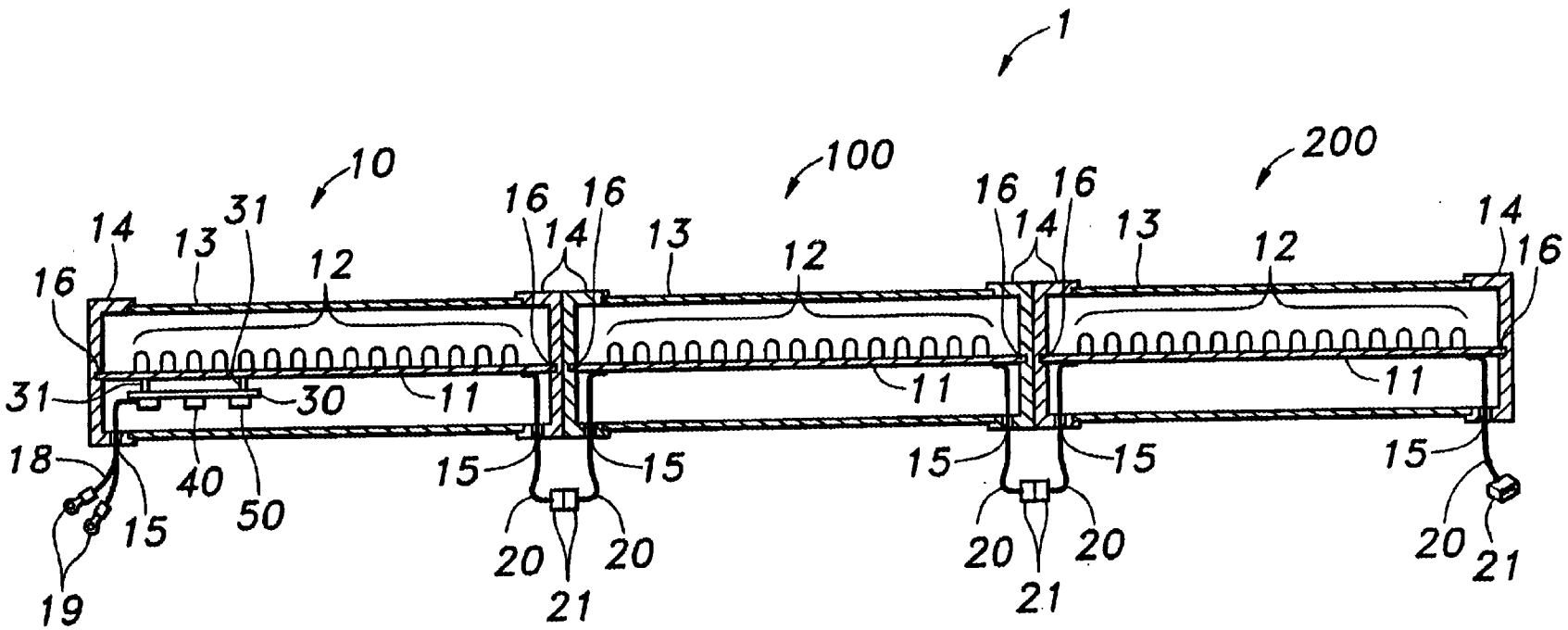
FIG. 2 is a longitudinal cross-sectional view of the illumination system shown in FIG. 1.

FIG. 1 is a perspective view of a preferred embodiment of an illumination system according to the present invention, and FIG. 2 is a longitudinal cross-sectional view of the illumination system of FIG. 1. As shown in the drawings, the illumination system 1 comprises a plurality of illumination units. Specifically, the illumination system 1 comprises one main illumination unit 10 (hereinafter called a "main unit") and two sub illumination units 100, 200 (hereinafter called "sub units"). It should be understood that although the embodiment of FIG. 1 includes only two sub units 100, 200, the number of sub units included may not be limited to two and more than two sub units may be included in the illumination system.

The main unit 10 comprises a first base plate 11, which preferably may consist of a printed circuit board; a plurality of light emitting elements 12 arranged on the first base plate 11 to serve as a light source; a longitudinal, cylindrical glass tube (cover member) 13 for accommodating the first base plate 11 and the light emitting elements 12 therein, the glass tube 13 having a light transmissive property and a diameter of about 30 mm, for example; and a pair of caps 14, 14 preferably made of a transparent material such as acrylic resin and fitted tightly on either ends of the longitudinal glass tube 13. Covering the light emitting elements 12 with the glass tube 13 and the pair of caps 14, 14 can advantageously prevent dust from causing damage to the illumination units or facilitate maintenance or cleaning of the units even when the illumination units are installed in a dusty environment. Each of the light emitting elements may consist of a light emitting diode (LED) or a small incandescent lamp covered with a color filter, for example, of which the LED will be preferable in view of the illumination efficiency, power consumption rate, etc. An electroluminescence (EL) device or discharge lamp may also be used as the light source.

The glass tube 13 is rotatably held by a pair of clamps 17, 17 (not shown in FIG. 2), which are longitudinally spaced from each other, so that the direction of the emitted light can be adjusted by rotating the glass tube 13. In the case of cove-lighting, for example, this can preferably allow a user to vary the area of a ceiling or the like to be illuminated by the illumination system so that a desired illumination effect can be achieved. On a side of the first base plate 11 opposite to that on which the LEDs 12 are arranged is disposed a second base plate 30 on which a control circuit 40 for controlling the LEDs 12, a power supply circuit 50, etc. are provided. As best shown in FIG. 2, the second base plate 30 is attached to the first base plate 11 via electrically conductive pins 31 so that mechanical support and electrical connection are simultaneously achieved.

Figure 3:
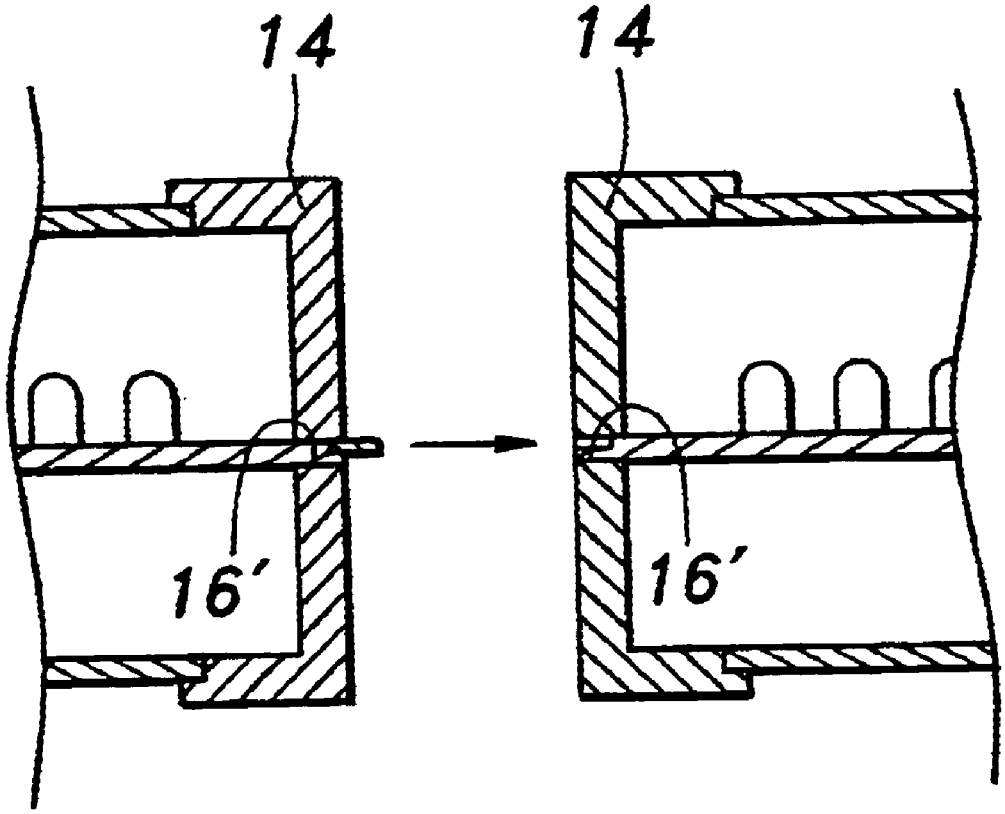
FIG. 3 is a partial cross-sectional view for showing another embodiment of a connector for connecting adjacent illumination units according to the present invention.

The pair of caps 14, 14 each have a cylindrical side wall formed with a hole 15. Through the hole 15 of one of the caps 14, 14 is drawn out a power cable 18 having a pair of crimp contacts 19, 19 for connection with a commercial AC power source (e.g., of 100V) and through the hole 15 of the other one of the caps 14, 14 is drawn out a connection cord (or leader line) 20 for connection with an adjacent sub unit 100. The connection cord 20 comprises four conductive wires which are connected to first through fourth pins (e.g., of a female type), respectively, arranged in a row within a connector 21 provided on an end of the connection cord 20. Each of the pair of caps 14, 14 also has a circular bottom wall, on an inner surface of which is formed a groove 16 for fittingly receiving the associated end of the first base plate 11 to thereby support the first base plate 11 within the glass tube 13. It should be noted that since the caps 14, 14 are transparent and the power cable 18 and connection cord 20 are drawn out from the side of the illumination unit, it is possible that longitudinally adjacent illumination units are placed closely to each other so that a "seamless" illumination having substantially no dark areas between the adjacent units can be achieved. Also, because the connection cord 20 is drawn out from a vicinity of an end of the illumination unit, the connection of the unit to another longitudinally (or axially) adjacent unit is facilitated. Although not shown in the drawings, it may be also possible to form a hole in the cylindrical wall of the glass tube 13 to allow the connection cord 20 to be drawn out through the hole of the glass tube 13 instead of the hole 15 of the cap 14. Also, as shown in FIG. 3, it may be possible to form a slit 16' in the caps 14 instead of the groove 16 and implement the connector 21 as an edge connector formed unitarily to the base plate 11 so that the electrical connection and mechanical connection of the adjacent illumination units can be achieved simultaneously by using the edge connector extending out through the slit 16'.

The sub units 100, 200 have a substantially same configuration as the main unit 10 but do not comprise the second base plate 30 attached with the control circuit 40 and the power supply circuit 50. Further, in the sub units 100, 200, instead of the power cable 18 having the crimp contacts 19, 19 for connection with the commercial power source, there is provided another connection cord 20 with a connector 21 comprising first through fourth pins (e.g., of a male type) for connection with an adjacent illumination unit. Since the sub units 100, 200 do not comprise the control circuit and power supply circuit, the manufacturing cost thereof is considerably reduced compared with the main unit 10.

Figure 4:
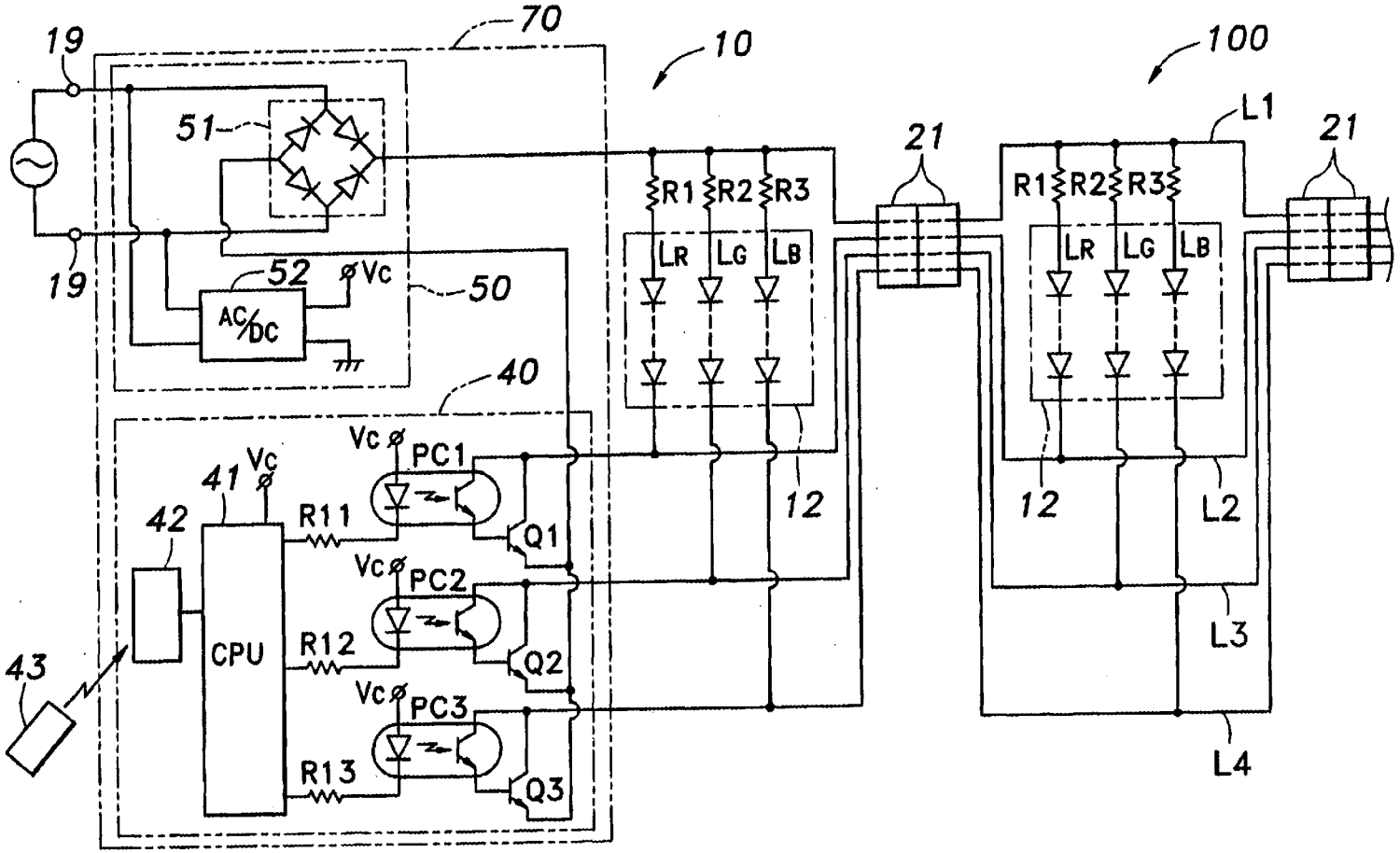
FIG. 4 is a schematic circuit diagram of the illumination system shown in FIG. 1.

FIG. 4 shows a preferred circuit of the illumination system 1 described above. In this embodiment, the illumination system 1 is configured as a color illumination system for producing various colors of light. As shown in FIG. 4, the pair of contacts 19, 19 provided to the power cable 18 of the main unit 10 are connected to the commercial AC power source having a voltage of 100V, for example. In the main unit 10, the power cable 18 is connected to a full-wave rectifying diode bridge 51, a positive output terminal of which is connected to the LEDs 12. It should be noted that although the shown embodiment comprises the diode bridge 51 to produce a rectified voltage for powering the LEDs 12 used as light emitting elements for constituting the light source, the diode bridge 51 may be omitted in such a case that incandescent lamps are used as the light emitting elements.

The LEDs 12 comprise red, green and blue LEDs. More specifically, they comprise a red LED set $L_R$having a series-connected plurality (e.g., 10) of red LEDs, a green LED set $L_G$ having a series-connected plurality (e.g., 10) of green LEDs, and a blue LED set $L_B$ having a series-connected plurality (e.g., 10) of blue LEDs. Each of the LED sets may have more than one series-connection of LEDs connected in parallel. Thus, in this embodiment, the red LED set $L_R$constitutes a red light source, the green LED set $L_G$ constitutes a green light source and the blue LED set $L_B$ constitutes a blue light source. Preferably, the LEDs of the three primary colors are mixedly arranged on the base plate 11 in order to achieve favorable mixture of the colored lights to thereby produce a uniform illumination light. The LEDs 12 may comprise a single-chip LED or a multi-chip LED that comprises a plurality of LED chips unitarily packaged in a body. Also, each LED 12 may be of a lamp type or of a surface mount type. It should be noted that if it is desired to configure the system specifically for use in a general lighting, instead of color lighting, the red, green and blue LED sets $L_R$, $L_G$, $L_B$ should be replaced with a white light source.

The red, green and blue LED sets $L_R$, $L_G$, $L_B$ are connected to the positive output of the diode bridge 51 via associated resisters R1, R2, R3 for limiting the maximum current flowing through the LED sets. The three primary color LED sets $L_R$, $L_G$, $L_B$ are also connected to the negative output of the diode bridge 51 via associated transistors Q1, Q2, Q3. In other words, in this embodiment, the LED sets $L_R$, $L_G$, $L_B$ are connected between the positive and negative outputs of the diode bridge 51, with the positive output of the diode bridge 51 serving as a common line for the LED sets $L_R$, $L_G$, $L_B$. It should be noted that although the shown embodiment uses the transistors Q1, Q2, Q3 as the switching elements, other devices such as thyristors or MOSFETs may be used as the switching elements. Also, though it may not be preferable in view of power dissipation or heat generation, it may be possible to use variable resistors, instead of the switching elements, as control elements to control the electric current flowing through the LED sets.

A base of each of the transistors Q1, Q2, Q3 is connected to an associated one of photo-couplers (or photo-isolators) PC1, PC2, PC3. Each of the photo-couplers PC1, PC2 PC3 comprises an LED and a photo-transistor, the photo-transistor forming a Darlington connection with an associated one of the transistors Q1, Q2, Q3. Thus, when an electric current flows through the LED in the photo-couplers PC1, PC2, PC3 to emit light, the light is detected by the associated photo-transistor which, in response to that, turns on to thereby turn on the associated one of the transistors Q1, Q2, Q3. Such photo-couplers are available, for example, from Toshiba Kabushiki Kaisha of Tokyo, Japan with a part number TLP628. It should be noted that it is also possible to use other types of photo-couplers such as containing a photo-diode or photo-thyristor instead of a photo-transistor.

As shown in FIG. 4, the main unit 10 comprises a CPU (or microprocessor) 41, which may be available, for example, from NEC Corporation, Tokyo, Japan, as a part number $\mu$PD78F9116AMC-5A4. As shown, the photo-couplers PC1, PC2, PC3 are connected to the CPU 41 via resistors R11, R12, R13, respectively, so that the electric current flowing through the LEDs in the photo-couplers PC1, PC2, PC3 can be controlled by signals from the CPU 41. In this way, it is possible to vary the intensity of light of each color by controlling on/off of the photo-transistors in the photo-couplers PC1, PC2, PC3 and thus controlling on/off of the corresponding transistors Q1, Q2, Q3 to thereby controlling the current flowing through the corresponding LED sets $L_R$, $L_G$, $L_B$.

Also connected to the CPU 41 is an infrared or radio signal receiver 42 for receiving signals from a remote controller 43 operable by the user and effecting various functions such as turning on/off of the power of the system and changing the color or brightness of the illumination light, etc. depending on the type or content of the received signals. If the CPU 41 is pre-programmed to set a plurality of functional modes such as an automatic color changing mode in which the illumination light color is changed periodically in a predetermined pattern or a flashing mode in which the illumination light is flashed with a predetermined cycle, the remote controller 43 may be also adapted to emit signals to selectively switch the functional modes or to adjust one or more operation parameters (e.g., the color changing cycle) defined according to the selected functional mode. Thus, in this embodiment, the transistors Q1, Q2, Q3, the photo-couplers PC1, PC2, PC3, the CPU 41 and the infrared/radio signal receiver 42 constitute the control circuit 40. It should be noted that for the sake of clarity, some of the connection pins of the CPU 41 are omitted in the drawing.

The power cable 18, which is connected to the diode bridge 52 as described above, is also connected to an AC/DC converter 51 for constituting the power supply circuit 50 together with the (first) diode-bridge 51. The AC/DC converter 52 provides a constant, low DC voltage Vc (e.g., 5V) which is supplied to the CPU 41, photo-couplers PC1, PC2, PC3, etc. as an operation voltage.

Figure 5:
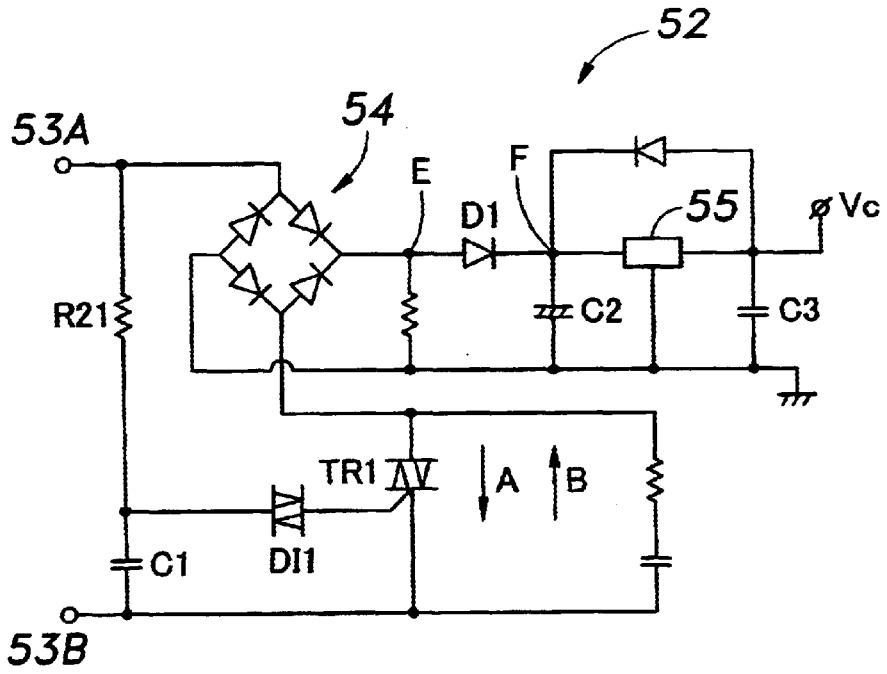
FIG. 5 is a schematic circuit diagram of an AC/DC converter shown in FIG. 4.

FIG. 5 shows a preferred circuit of the AC/DC converter 52. The AC/DC converter 52 comprises first and second voltage terminals 53A, 53B to which an AC voltage is provided via the power cable 18. The first voltage terminal 53A is connected to one of a pair of input terminals of a second full-wave diode bridge 54, the other input terminal of which being connected to the second voltage terminal 53B via a triac TR1. Between the first voltage terminal 53A and the second voltage terminal 53B are connected a resistor R21 and a capacitor C1 in series and in this order, and the gate of the triac TR1 is connected to a node between the resistor R21 and the capacitor C1 via a diac (or trigger diode) DI1. On an output side of the diode bridge 54 is connected a three-terminal regulator 55 having an input side and an output side provided with smoothing capacitors C2, C3, respectively.

Figure 6:
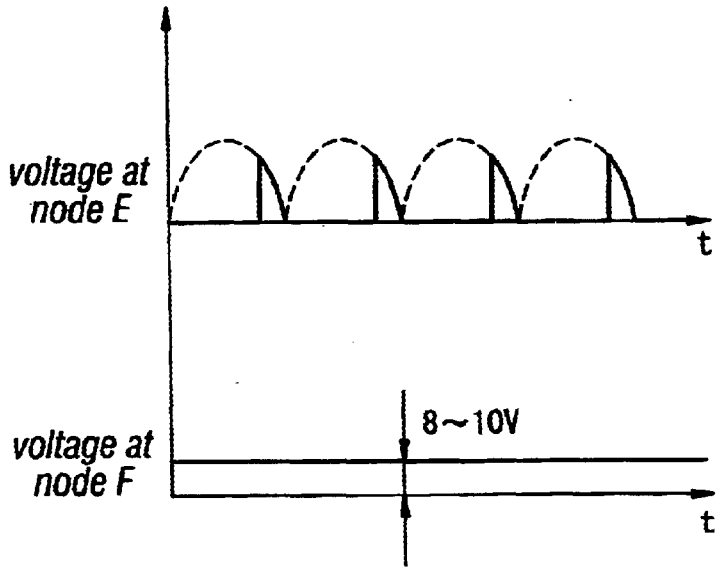
FIG. 6 is a graph showing voltages at nodes B and F in FIG. 5.

An operation of the above constructed AC/DC converter 52 is described with reference to FIG. 6 which shows voltages at node E and node F in FIG. 5. In a duration of a positive half-wave of the AC power source voltage (in other words, when the voltage at the First voltage terminal 53A is greater than the voltage at the second voltage terminal 53B), the capacitor C1 is charged via the resistor R21 with a prescribed time-constant, and when the absolute value of the voltage of the capacitor C1 reaches a threshold value of diac DI1, the diac DI1 turns on. Then, as a result of the turning on of the diac DI1, a trigger signal is provided to the gate of the triac TR1 to turn on the triac TR1 allowing an electric current to flow in the direction shown by an arrow A in the drawing. In a duration of a negative half-wave of the AC power source voltage, the capacitor C1 is charged in the opposite polarity and, when the absolute value of the capacitor voltage exceeds the threshold voltage of the diac DI1, the diac DI1 turns on and the electric current flows through the direction indicted by an arrow B in the drawing. In this way, the triac TRI turns on at a certain firing angle determined by the resistor R21, capacitor C1 and diac DI1 to selectively permit electric current flow through the diode bridge 54 which, as a result, provides a voltage at the node E shown in the upper waveform of FIG. 6. The voltage at the node B is averaged by the smoothing capacitor into a voltage of about 8 to 10 V at the node F as shown by the lower waveform of FIG. 6. The averaged voltage at the node F is then reduced by the three-terminal regulator 55 to produce the DC voltage Vc of 5V, for example.

The above-described AC/DC converter 52 does not include a step down transformer (referred to herein as transformer-less configuration), which can result in a reduced manufacturing cost and size of the convener 52 so that the converter 52 can be attached to the second base plate 30 and accommodated in the glass tube 13. Thus, the main unit 10, which comprises the LEDs 12, control circuit 40 and power supply circuit 50 all accommodated in the glass tube 13, achieves a favorable color illumination unit that is easy to handle, has a small footprint and can be connected directly to the commercial AC power source so that it can be used as an independent, stand-alone illumination device. It should be noted that, as the case may be, the infrared/radio signal receiver 42 may be situated at a place out of the main unit 10 where the receiver 42 can receive the signals from the remote controller 43 easily and reliably.

Referring to FIG. 4 again, the positive output terminal of the diode bridge 51, which serves as a common line, and the negative or cathode sides of the LED sets $L_R$, $L_G$, $L_B$ of the main unit 10 are connected to first through fourth pins (shown in broken lines in the drawing), respectively, of the four-pin connector 21.

Similarly to the main unit 10, the sub unit 100 comprises LED sets $L_R$, $L_G$, $L_B$ and resistors R1, R2, R3 connected in series to the LED sets $L_R$, $L_G$, LB, respectively. Unlike the main unit 10, the sub unit 100 comprises a pair of four-pin connectors 21, 21, each comprising first through fourth pins. As shown, the first through fourth pins of one of the connectors 21, 21 are connected to the first through fourth pins of the other one of the connectors 21, 21, respectively (it should be understood that the first though fourth lines L1–L4 corresponds to the four conductive lines in the connection cord 20 shown in FIG. 1). The red LED set $L_R$, is connected between the first line L1 and the second line L2, the green LED set $L_G$ between the first line L1 and the third line L3, and the blue LED set $L_B$ between the first line L1 and the fourth line L4. In this way, the pair of connectors 21, 21 of the sub unit 100 are commonly connected to the light source consisting of the rod, green and blue LED sets $L_R$, $L_G$, LB.

Thus, by connecting the corresponding pins of the connectors 21 of the main unit 10 and the sub unit 100, as shown in broken lines in FIG. 4, the LED sets $L_R$, $L_G$, $L_B$ in the sub unit 100 are connected in parallel with the corresponding LED sets $L_R$, $L_G$, $L_B$ in the main unit 10, respectively. This allows the power supply circuit 50 in the main unit 10 to supply electric power to the sub unit 100 as well as enables the control circuit 40 in the main unit 10 to control the sub unit 100, which accordingly may not have to include the power supply and control circuits. The sub unit 100 also does not need to have its own power cable for direct connection to the outside power source and thus, no space for cable routing is necessary when installed, and the time and effort for installation is considerably reduced.

Further, the sub unit 200 having an identical configuration to the sub unit 100 may be connected to the sub unit 100 so that the LED sets $L_R$, $L_G$, $L_B$ in the sub unit 200 are connected in parallel to the corresponding LED sets $L_R$, $L_G$, $L_B$ in the main unit 10 (and naturally in the sub unit 100). In general, according to the present invention, an arbitrary number of sub units can be joined to form a color illumination system 1 having a desired length.

As described above, in the sub units 100, 200, the control circuit 40, power supply circuit 50, etc., can be omitted and this can beneficially minimize the total system cost increase when such sub units are added to the main unit 10. Since a typical rated power consumption of a single LED is about 80 mW, a sub unit comprising 30 of such LEDs consumes electric power of only about 2.4 W, allowing a plurality of such sub units to be joined together without practically causing no heat problem. Also, by connecting adjoining units via connectors of each unit, it is possible to supply electric power from the main unit to each sub unit without separately providing power cables for connection to the outside power source, whereby the cable routing of the system is considerably simplified.

Figure 7:
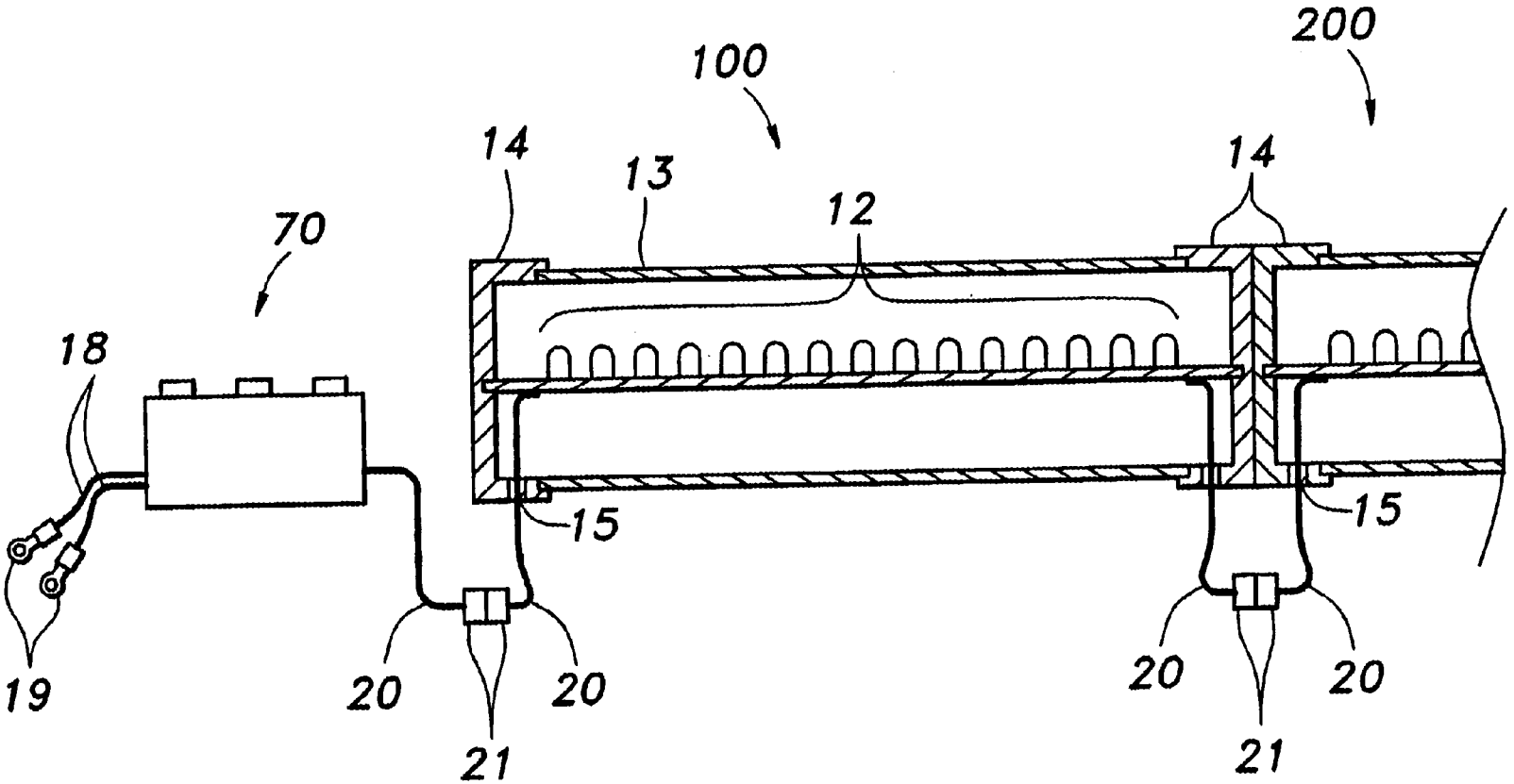
FIG. 7 is a longitudinal cross-sectional view of a second embodiment of the illumination system according to the present invention.

FIG. 7 is a longitudinal cross-sectional view for showing another embodiment of the present invention. In this second embodiment, a control/power supply circuit 70 comprising the control circuit 40 and the power supply circuit 50 as shown in FIG. 4 is implemented as a separate, independent unit. In this way, the color illumination system 1 can be constituted by the control/power supply unit 70 and one or more of sub unit 100 (200) to achieve the same advantages as provided by the above-described first embodiment. The unit 70 may not have to be located near the illumination units 100, 200 at the site. Rather, the unit 70 may be equipped, in addition to or instead of the remote signal receiver 42, with a rotary or slide-type control(s) for controlling the illumination brightness and/or color and installed on an interior wall surface of a room or the like so that the controls can be operated by the user.

Figure 8:
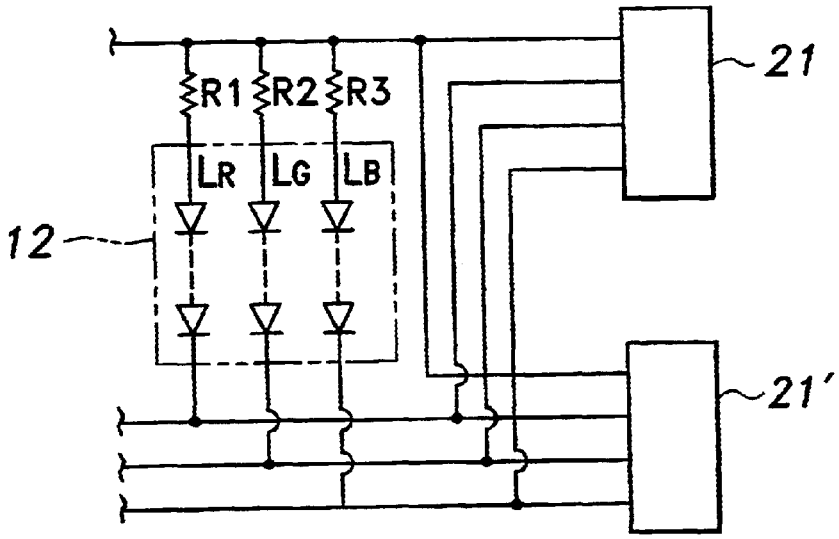
FIG. 8 is a partial circuit diagram of a preferred embodiment of an illumination unit that can be used in the illumination system according to the present invention.

FIG. 8 is a partial circuit diagram for showing another embodiment of an illumination unit according to the present invention. The illustrated embodiment differs from the main unit 10 or the sub unit 100 in FIG. 4 in a sense that the illumination unit of FIG. 8 comprises an additional four-pin connector 21' having first through fourth pins connected to the common line and cathode-side ends of the LED sets $L_R$, $L_G$, $L_B$ (i.e., connected in parallel to the connector 21).

Figure 9:
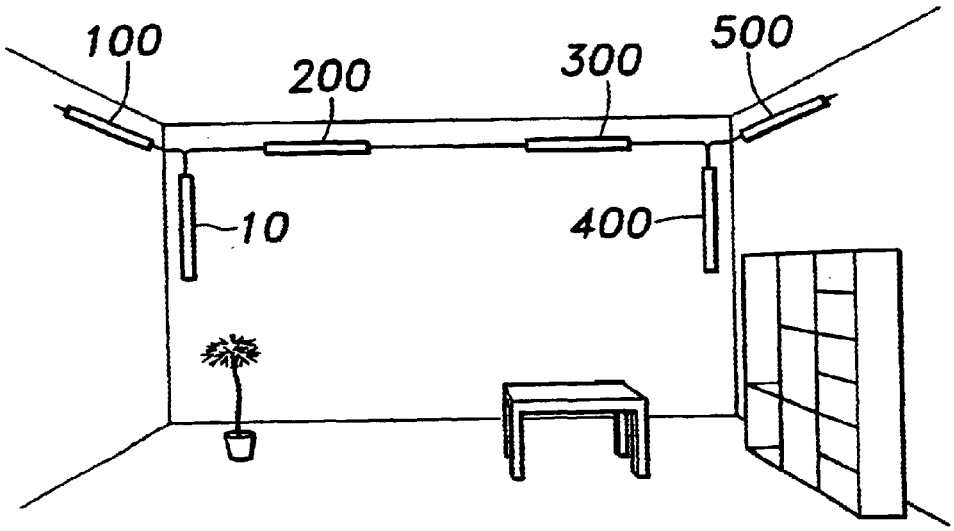
FIG. 9 is a schematic view for showing an exemplary layout of the illumination system according to the present invention.
Figure 10:
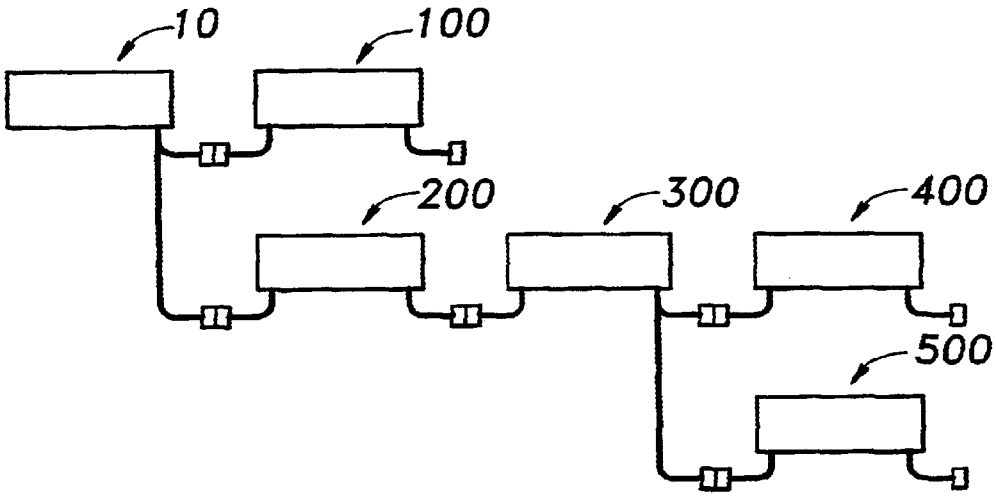
FIG. 10 is a schematic diagram for showing the way of connection between the illumination units in the illumination system of FIG. 9.

FIGS. 9 and 10 schematically show an exemplary layout and connection structure, respectively, of an illumination system comprising the main unit 10 and a plurality of sub units 100–500 to which the connector configuration shown in FIG. 8 is applied. In the shown embodiment, the main unit 10 and the sub unit 300 each comprise a pair of connection cords connected in parallel in one end portion thereof for enabling "bifurcation joint" of the units. As shown, by comprising such units that enable bifurcation joint, it is possible to easily achieve a three dimensional layout of the illumination units on different walls, ceiling, etc. to thereby improve the freedom of illumination design significantly. It should be noted that in FIG. 9, coves for mounting and concealing the illumination units are omitted to show the exemplary system layout clearly. Also it should be noted that the number of connectors (or connection cords) provided on one end portion of a unit may not be limited to two, and more than two connectors (or connection cords) connected in parallel may be provided.

Figure 11:
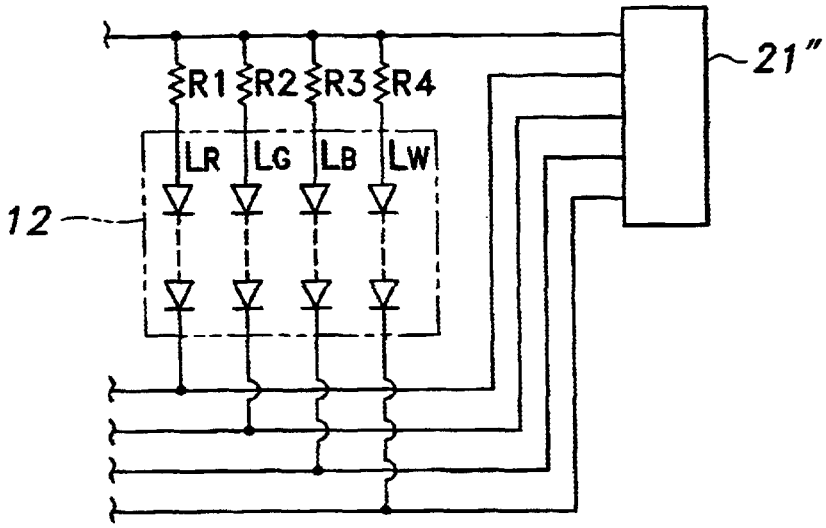
FIG. 11 is a partial circuit diagram of yet another embodiment of the present invention in which a white LED set $L_W$ is additionally provided.

FIG. 11 is a partial circuit diagram for showing yet another embodiment of the present invention. In this embodiment a white LED act $L_W$ is used in addition to the LED sets of three primary colors. As shown, this embodiment comprises a five-pin connector 21" for connection to another illumination unit having a similar structure. In such a configuration, it is possible to conduct general lighting easily by turning on only the white LED set $L_W$, instead of separately adjusting the intensity of lights emitted from the red, green and blue LED sets.

Figure 12:
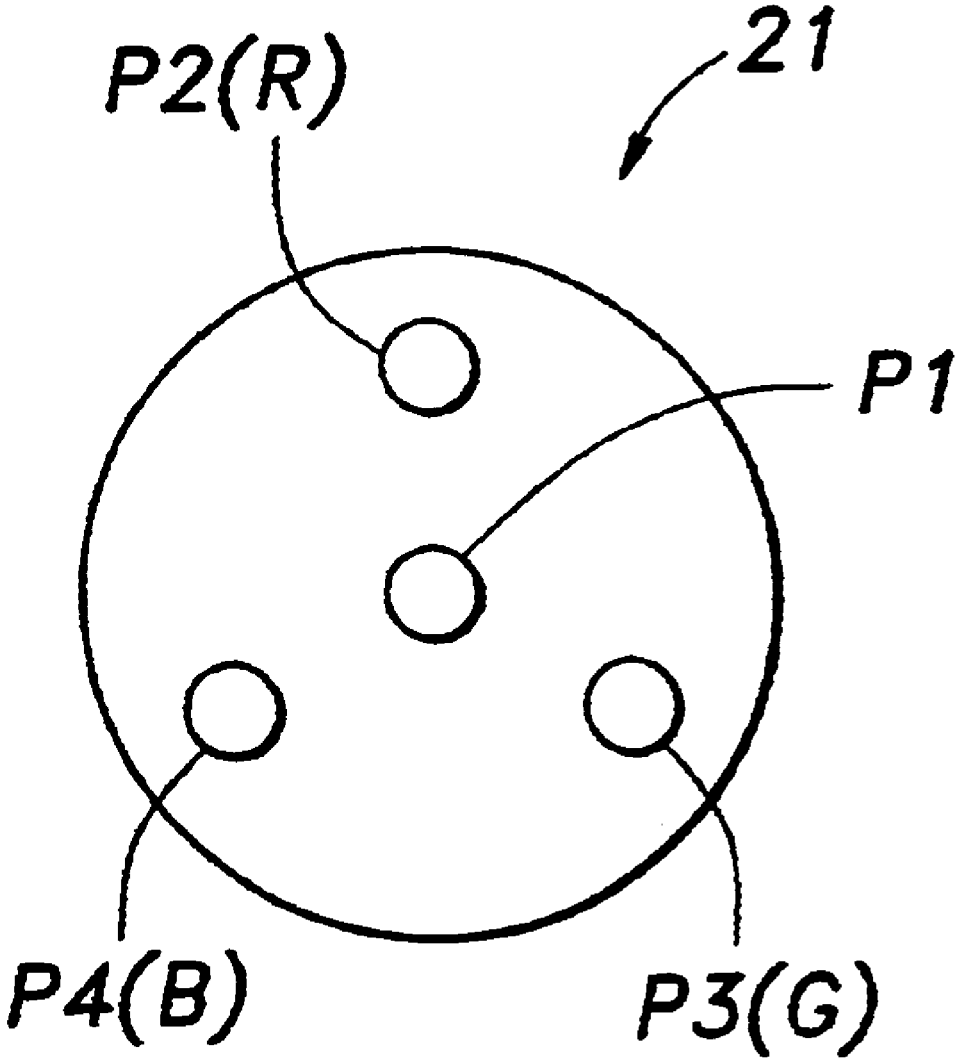
FIG. 12 is an end view for showing a modified embodiment of a connector for connecting adjacent illumination units according to the present invention.

FIG. 12 is an end view for showing a modified embodiment of a connector 21 for connection between adjacent illumination units. As shown, this embodiment of the connector 21 comprises a first pin P1 (connected to the common line) positioned at a center of the connector 21, and second, third and fourth pins P2, P3, P4 arranged around the first pin PI and circumferentially spaced apart from each other by an angle of 120 degrees. By adopting such a connector in the main unit 10 and sub unit 100, for example, the following three ways of connection can be possible by relatively rotating the connectors around the first pin P1 to thereby vary the combination of the pins to be connected together (wherein R, G, B in the parentheses show the color of the LED set associated with each pin):

| main unit | sub unit |
|---|---|
| First Connection | |
| first pin (common) | first pin (common) |
| second pin (R) | second pin (R) |
| third pin (G) | third pin (G) |
| fourth pin (B) | fourth pin (B) |
| Second Connection | |
| first pin (common) | first pin (common) |
| second pin (R) | fourth pin (B) |
| third pin (G) | second pin (R) |
| fourth pin (B) | third pin (G) |
| Third Connection | |
| first pin (common) | first pin (common) |
| second pin (R) | third pin (G) |
| third pin (G) | fourth pin (B) |
| fourth pin (B) | second pin (R) |

In the first connection where the pins of the same number are connected together, the LED sets of the same color in these illumination units are controlled commonly by the same transistor (Q1–Q3). Therefore, when the red light emitted from the main unit 10 is enhanced, for example, the red light emitted from the sub unit 100 is also enhanced.

In the second and third connections, the LED sets of different colors are controlled by a same photo-coupler PC1–PC3 (or transistor Q1–Q3). Therefore, when the red light emitted from the main unit 10 is enhanced, for example, the blue or green light is enhanced in the sub unit 100. Thus, by using the connector 21 shown in FIG. 12, a desired connection can be selected from the three different connections, thus allowing a wider range of illumination effects. Of course, such a connector can be also used in connecting adjacent sub units.

As described above, according to a first embodiment of the present invention, it is possible to constitute an Illumination system of a desired length by connecting one or plurality of sub illumination units not equipped with control and power supply circuits to a main illumination unit comprising a control circuit and power supply circuit. Since the sub unit can be manufactured at relatively low cost, an increase in the total cost of the illumination system using a plurality of sub units can be minimized. Further, since each illumination unit can be supplied with electric power via adjacent illumination unit connected thereto via the connection cord, there is no need for each illumination unit to have its own power cable for direct connection to an outside power source such as the commercial AC power source, and therefore, an effort and time required for the cable routing can be considerably reduced.

According to a second embodiment of the present invention, one or more of sub units are connected to a control/power supply unit, which has a control circuit and a power supply circuit, to constitute an illumination system of a desired length and provide similar effects as in the first embodiment.

Although the present invention has been described in terms of a preferred embodiment thereof, it is obvious to a person skilled in the art that various alterations and modifications are possible without departing from the scope of the present invention which is set forth in the appended claims.

For example, since the above embodiments were for color illumination, the present invention can be applied to general illumination system comprising a white light source. Also, when achieving color illumination, an illumination unit may not necessarily contain all of the three primary color light sources (i.e., LED sets $L_R$, $L_G$, LB). The illumination unit may also contain a light source of another color. Further, in the above embodiments, the control elements (photo-couplers PC1–PC3 and transistors Q1–Q3) constituting the control circuit for controlling electric current through the three primary color LED sets $L_R$, $L_G$, $L_B$ were provided between the respective LED sets and the negative output side of the diode bridge 51 so that the positive output side of the diode bridge 51 served as the common line for the LED sets, but alternatively, it is also possible to use the negative output end of the diode bridge as the common line.

Further, although the above embodiments comprised a cylindrical glass tube 13 as a light transmissive cover member for covering the light source and base plate, the cover member may be of any shape suitable for a specific light source arrangement, shape of the base plate, and use of the system, etc. For example, the glass tube 13 may be curved so as to form a part of a ring. Instead of a transparent glass tube, it is also possible that the tube 13 assumes a light-diffusive milky-white color. The tube 13 may have inner or outer surface formed with suitable cuttings, and may be made of a material other than glass, such as a plastic.

What is claimed is:

1. An illumination system, comprising:

a first illumination unit comprising a pair of power supply contacts for connection to a commercial AC power source, a light source connected between the pair of power supply contacts, a control circuit connected in series to the light source to control electric current flowing through the light source, and a first connection cord connected to the light source; and a second illumination unit comprising a light source and a first connection cord connected to the light source, wherein the first illumination unit comprises a longitudinal support member for supporting the light source, and the control circuit is mounted to the support member, and wherein the first connection cord of the first illumination unit and the first connection cord of the second illumination unit are connected to each other so that the light source of the first illumination unit and the light source of the second illumination unit are connected in parallel to each other, whereby making it possible for the control circuit of the first illumination unit to control an electric current flowing through the light source of the second illumination unit.

2. An illumination system according to claim 1, wherein the first illumination unit further comprises a second connection cord connected to the light source commonly with the first connection cord;

the system further comprises a third illumination unit comprising a light source and a first connection cord connected to the light source; and the second connection cord of the first illumination unit is connected to the first connection cord of the third illumination unit so that the light source of the first illumination unit and the light source of the third illumination unit are connected in parallel to each other.

3. An illumination system according to claim 1, wherein the second illumination unit further comprises a second connection cord connected to the light source commonly with the first connection cord.

4. An illumination system according to claim 1, wherein each of the illumination units comprises a longitudinal support member for supporting the light source, and each connection cord is provided in a vicinity of an associated longitudinal end of the support member of each illumination unit.

5. An illumination unit comprising:

a light source, and a connection cord connected to the light source, wherein the light source comprises a red light source, a green light source and a blue light source, and the connection cord is provided with a connector which has a first pin connected to a common line, a second pin connected to the red light source, a third pin connected to the green light source and a fourth pin connected to the blue light source.

6. An illumination system comprising:

first and second illumination units, each having a light source and first and second connection cords commonly connected to the light source; and a control unit separate from the first and second illumination units, the control unit having a pair of power supply contacts and a control circuit, wherein the first illumination unit is connected to the control unit via its first connection cord so that the light source of the first illumination unit is connected between the pair of power supply contacts of the control unit via the control circuit of the control unit;

wherein the second connection cord of the first illumination unit is connected to the first connection cord of the second illumination unit so that the light source of the first illumination unit and the light source of the second illumination unit are connected in parallel to each other;

wherein each of the first and second illumination unit has a longitudinal support member for supporting the light source and each connection cord is provided in a vicinity of an associated end of the support member of each illumination unit; and wherein each of the first and second illumination units further comprises a light-transmissive tubular member for accommodating the support member and the light source, and a cap member having a bottom wall and a cylindrical side wall and attached to an end of the tubular member, with the bottom wall being formed with a groove or slit for receiving an associated end of the support member.

7. An illumination system according to claim 6, wherein the side wall of the cap member is formed with a hole through which an associated connection cord is passed.

8. An illumination system according to claim 6, wherein the light source of each of the first and second illumination units comprises a plurality of light emitting elements, and the longitudinal support member consists of a printed circuit board on which the plurality of light emitting elements are mounted.

9. An illumination system comprising:

first and second illumination units, each having a light source and first and second connection cords commonly connected to the light source; and a control unit separate from the first and second illumination units, the control unit having a pair of power supply contacts and a control circuit, wherein the first illumination unit is connected to the control unit via its first connection cord so that the light source of the first illumination unit is connected between the pair of power supply contacts of the control unit via the control circuit of the control unit;

wherein the second connection cord of the first illumination unit is connected to the first connection cord of the second illumination unit so that the light source of the first illumination unit and the light source of the second illumination unit are connected in parallel to each other; and wherein:

the light source of each of the first and second illumination units comprises a red light source, a green light source and a blue light source;

the control circuit comprises first, second and third control elements connected in series to the red light source, green light source and blue light source, respectively, of the first illumination unit; and the second connection cord of the first illumination unit and the first connection cord of the second illumination unit are connected to each other so that light sources of a same color in these illumination units are connected in parallel to each other so that an electric current flowing through each parallel connection of the light sources can be controlled variably and independently from the other parallel connections of the light sources by operating the associated control element.

10. An illumination system according comprising:

first and second illumination units, each having a light source and first and second connection cords commonly connected to the light source; and a control unit separate from the first and second illumination units, the control unit having a pair of power supply contacts and a control circuit, wherein the first illumination unit is connected to the control unit via its first connection cord so that the light source of the first illumination unit is connected between the pair of power supply contacts of the control unit via the control circuit of the control unit;

wherein the second connection cord of the first illumination unit is connected to the first connection cord of the second illumination unit so that the light source of the first illumination unit and the light source of the second illumination unit are connected in parallel to each other; and wherein:

the light source of each of the first and second illumination units comprises a red light source, a green light source and a blue light source;

the control circuit comprises first, second and third control elements connected in series to the red light source, green light source and blue light source, respectively, of the first illumination unit; and the second connection cord of the first illumination unit and the first connection cord of the second illumination unit are provided with respective connectors, the connectors being adapted so that light sources of different colors in the first and second illumination units can be connected in parallel to each other via the connectors so that an electric current flowing through each parallel connection of the light sources can be controlled variably and independently from the other parallel connections of the light sources by operating the associated control element.

11. An illumination system according to claim 9, wherein the red light source comprises a red LED set having a series-connected plurality of red LEDs, the green light source comprises a green LED set having a series-connected plurality of green LEDs, and the blue light source comprises a blue LED set having a series-connected plurality of blue LEDs, and wherein each of the first, second and third control elements consists of a switching element.

12. An illumination system according to claim 10, wherein the red light source comprises a red LED set having a series-connected plurality of red LEDs, the green light source comprises a green LED set having a series-connected plurality of green LEDs, and the blue light source comprises a blue LED set having a series-connected plurality of blue LEDs, and wherein each of the first, second and third control elements consists of a switching element.

13. An illumination unit according to claim 5, further comprising a longitudinal support member for supporting the light source, and a plurality of the connection cords, wherein at least one of the connection cords is provided in a vicinity of one end of the support member and at least one of the other connection cords is provided in a vicinity of the other end of the support member.

* * * * *